United States Patent [19]

Leskovec

[11] 4,330,007

[45] May 18, 1982

[54] POTENTIOMETER AND SWITCH CONTROL ARRANGEMENT

[75] Inventor: Edward V. Leskovec, Eastlake, Ohio

[73] Assignee: Towmotor Corporation, Mentor, Ohio

[21] Appl. No.: 245,237

[22] PCT Filed: May 5, 1980

[86] PCT No.: PCT/US80/00519

§ 371 Date: May 5, 1980

§ 102(e) Date: May 5, 1980

[87] PCT Pub. No.: WO81/03209

PCT Pub. Date: Nov. 12, 1981

[51] Int. Cl.[3] ..... F15B 13/08

[52] U.S. Cl. ..... 137/565; 60/434; 60/484; 60/DIG. 2; 91/530

[58] Field of Search ..... 60/434, 484, DIG. 2; 91/530; 137/565

[56] References Cited

U.S. PATENT DOCUMENTS 3,962,871 6/1976 Blaha et al. ..... 60/484 X 4,102,132 7/1978 Palmer ..... 60/484 X

*Primary Examiner*—Gerald A. Michalsky

*Attorney, Agent, or Firm*—Phillips, Moore, Weissenberger, Lempio & Majestic

[57] ABSTRACT

A number of systems exist wherein a plurality of hydraulic motors (28*a*, 28*b*, 28*c*) receive pressurized fluid from a single pump (14) which is itself driven by an electric motor (12). Apparatus has been available for adjusting the power supplied to the electric motor (12), and thereby adjusting the pump (14) flow rate, in response to the operator activating one or more of the hydraulic motors (28*a*, 28*b*, 28*c*). However, such apparatus has generally been bulky, complicated and/or difficult to install and/or service. An improvement is provided wherein a single switch (22) is placed in either an open or closed position as an elongated member (34) placed transversely to a plurality of generally parallel rod member (20*a*, 20*b*, 20*c*) is rotated in response to longitudinal travel in either direction from a neutral position (32) of one of the rod member (20*a*, 20*b*, 20*c*). Longitudinal movement of each of the rod members (20*a*, 20*b*, 20*c*), controls, via a respective valve (16*a*, 16*b*, 16*c*), the action of the respective hydraulic motor (28*a*, 28*b*, 28*c*).

9 Claims, 4 Drawing Figures

POTENTIOMETER AND SWITCH CONTROL ARRANGEMENT

DESCRIPTION

1. Technical Field

This invention relates to control of hydraulic circuits of the type including a plurality of hydraulic motors operable by separate control valves, with fluid under pressure for the various valves and hydraulic motors being supplied by a single pump.

2. Background Art

Hydraulic circuits of the type contemplated by the present invention are commonly employed, for example, in material handling vehicles such as lift trucks where the vehicles include a number of hydraulic motors or jacks which must be separately operable to regulate material handling implements associated with the vehicles. For example, one of the motors might be used to control tilting of a mast assembly of a lift truck, another might be used to control side shifting of a lift truck carriage, still another of the motors might be utilized to rotate the carriage and yet another of the motors might be utilized to control lifting of the carriage relative to the lift truck mast assembly.

There are a number of other machines which include a plurality of hydraulic motors which may be operated by a single hydraulic pump. The present invention provides a control apparatus which may be adapted to use with such machines.

Apparatus is available, for example, as shown in U.S. Pat. No. 4,102,132 of Norman H. G. Palmer issued July 25, 1978, wherein individual switches are tripped by the control spools of the control valves for each of the functions of a lift truck. This is relatively complicated, however, in that the circuitry must be such as to accommodate the several switches. Also, each switch must be properly aligned and positioned. Further, the switches must be located beneath the control valves in a position difficult to service and subject to oil and dirt contamination.

It is known to have separate control valves for separate hydraulic motors and to supply fluid under pressure to all the control valves from a single hydraulic pump. U.S. Pat. No. 3,962,871 of James G. Blaha and Richard C. Maher, issued June 15, 1976, illustrates one useful control or synchronizing unit which serves to initiate or terminate operation of the hydraulic pump, responsive to positioning of the spools of any one of a number of control valves. The control unit of this patent does not directly actuate the pump on response to linear travel of control rods which position the spools of the control valves. Instead, levers are rotated as the spools are moved linearly, with the free ends of the levers bearing against cam shoes which are attached to a gang plate. Rotation of the gang plate actuates a switch which controls the pump motor. Such units are relatively difficult to adjust, since each of the cam shoes must be separately adjusted. Also, control is not as precise as would be desired. Further, the various cam shoes are relatively expensive to manufacture, thus, adding to the overall cost of the unit.

Still further, the control unit of the aforementioned patent is not useful in all environments because of its bulk. In particular, such a unit is relatively bulky for use in lift trucks where the unit is to be mounted adjacent the operator's seat. Thus, when such units have been utilized in lift trucks, they have generally been mounted forward in the operator compartment and relatively far away from the operator seat. This has required the operator to lean forward to move the control knobs of the unit, thus lessening, somewhat, operator control of the various hydraulic motors.

The present invention is directed to overcoming one or more of the problems as set forth above.

DISCLOSURE OF INVENTION

According to the present invention, an improvement is provided in a hydraulic system having an electric motor driven pump which supplies pressurized fluid to a control valve arrangement having a plurality of spool controlled valves which move from neutral in response to generally longitudinal movement of one of a plurality of rod members from a neutral position. A single electric switch is provided in a circuit supplying power to the motor. The switch, when in a respective one of an open and a closed position, directs electric power to the motor, to rotate the pump and deliver pressurized fluid. When the switch is in a respective other of the open and closed positions, there is no electric power delivered to the motor. The improvement comprises an elongated actuating member having a neutral position, along with means for mounting the member transversely to the rod members and to pivot about an axis orthogonal to the rod members. The actuating member is biased into its neutral position. Means are provided which engage the rod members with the actuating member and pivot the actuating member in a single direction from its neutral position when one of the rod members moves in either direction from its neutral position. The switch is actuated to supply power to the pump motor when the actuating member is pivoted in the single direction.

In another embodiment, an improvement is provided in a hydraulic system having an electric motor driven pump which supplies pressurized fluid to a spool controlled valve with the spool being controlled by generally longitudinal movement of a rod member. The system has a control element near the rod member and means for moving the control element in response to generally longitudinal movement of the rod member. Means are provided which vary the amount of power supplied to the motor in response to movement of the control element. Means are also provided for stopping movement of the control element in one direction, sufficient to damage the power varying means. The improvement comprises having the control element moving means include means for allowing the rod member to continue to move in a direction, after the stopping means has prevented further movement of the control element in one direction.

It is desirable to either actuate the pump motor or step up the speed thereof, in direct response to linear travel of the control rods which move the control valve spools of control valves which thereby control various hydraulic motors of an apparatus, all of which motors operate from a single pump. It is also desirable that the apparatus be non-bulky, inexpensive, and easy to install. Such an improvement is provided herein by placing a single electrical switch in a desired position, for example, an on or off position, in response to travel of any one of the rods which adjusts the movement of any one of a plurality of control spools.

BEST MODE FOR CARRYING OUT THE INVENTION

Figure 1:
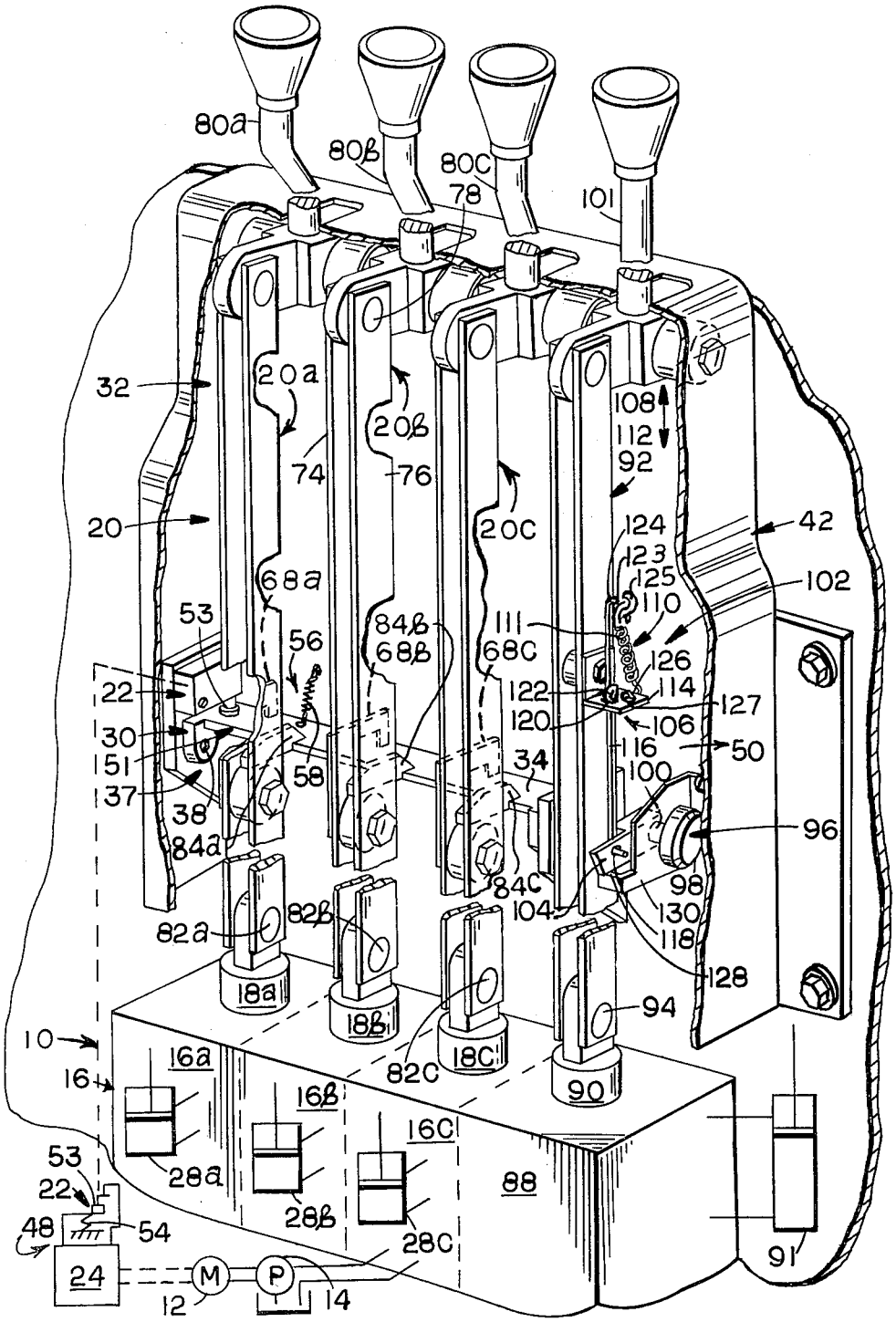
FIG. 1 is a perspective view of an embodiment of the subject apparatus having portions partially cut away and portions shown schematically.

Adverting first to FIG. 1, there is illustrated therein a hydraulic system 10 of the nature wherein an electric motor 12 drives a pump 14 which supplies pressurized fluid to a stacked control valve arrangement 16, comprising a plurality of control valves 16*a*, 16*b* and 16*c*, having control spools 18*a*, 18*b* and 18*c*, respectively. The control spools 18*a*, 18*b* and 18*c* are responsive to generally longitudinal movement of a rod structure 20, and more particularly responsive to movement of respective generally parallel rod members 20*a*, 20*b* and 20*c*.

A single electric switch 22, seen both structurally and schematically in FIG. 1, is provided in a circuit 24, which supplies power from a voltage source, such as a lift truck battery, to the motor 12. The switch 22 is actuatable between a first and second position. When in one of the first and second positions, e.g., the first position, electric power is directed to the motor 12, and, when in the other of the first and second positions, e.g., the second position, electric power is blocked to the motor 12. No electric power is supplied to the motor 12 when the switch 22 is in the other position. For example, if the first position is closed, electric current will be directed to the motor 12 and will be blocked from the motor 12 in the second (open) position (as illustrated). As an alternative, the closed position can be lead to a step up in power supplied from a lower to a higher value. In any event, a relatively greater amount of power is supplied to the motor 12 when the switch 22 is in the one position than is supplied when the switch 22 is in the other position. The present invention is not directed to any specific circuitry for accomplishing the supplying of power to the motor 12. Circuitry which may be utilized is shown in previously discussed U.S. Pat. No. 4,102,132. Since the present invention uses only a single switch 22 for the same purpose as the circuit of U.S. Pat. No. 4,102,132 uses four microswitches, three of the parallel branches of the circuit of U.S. Pat. No. 4,102,132 are omitted.

The control valve arrangement 16 directs flow from the pump 14 to one or more hydraulic motors 28*a*, 28*b* and 28*c*. Such comprise conventional structures and are well-known in the art.

Figure 2:
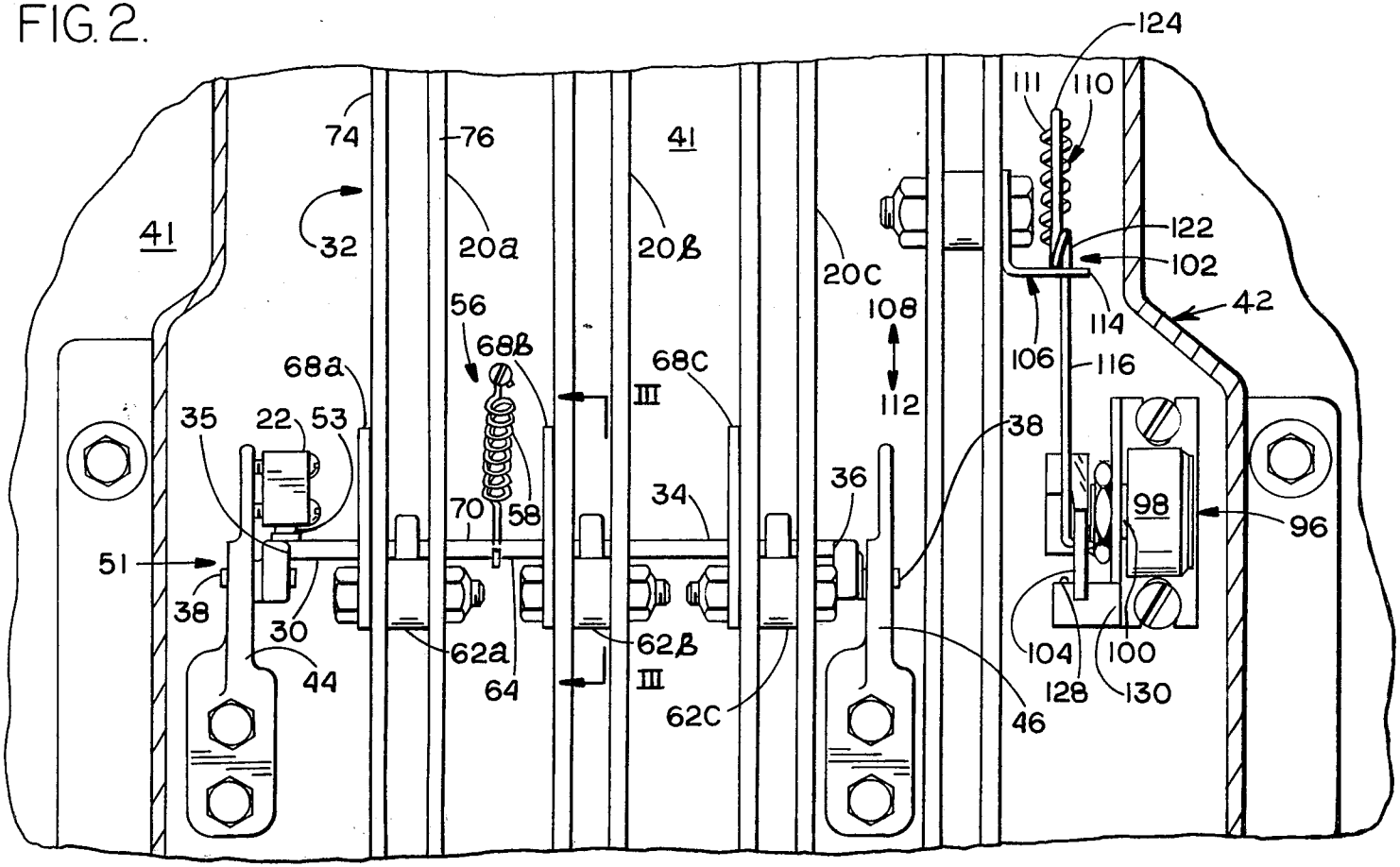
FIG. 2 is an enlarged front partial view, partially in section of the embodiment illustrated in FIG. 1.
Figure 3:
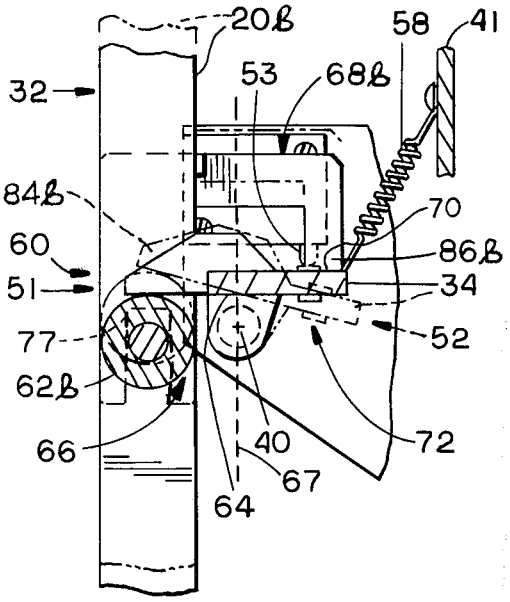
FIG. 3 is a sectional view taken along line III—III of FIG. 2, showing one operation position of the improvement in phantom.
Figure 4:
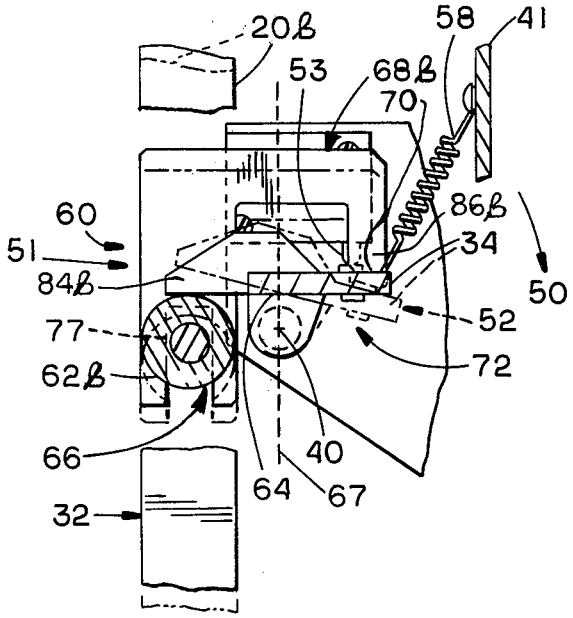
FIG. 4 is a sectional view taken along line III—III of FIG. 2, showing another operation position of the improvement in phantom.

In accordance with the present invention, means 30 are provided for placing the switch 22 in the first position, in response to generally longitudinal travel of any of the rod members 20*a*, 20*b* and 20*c* in either direction from a neutral position 32 as illustrated in FIG. 1 and 2, and in solid lines in FIGS. 3 and 4. The neutral position 32 of the rod members 20*a*, 20*b* and 20*c* corresponds to the switch 22 being in the second (other) position. The neutral position 32 of the rod members 20*a*, 20*b* and 20*c* also corresponds to the spools 18*a*, 18*b*, 18*c* being in their neutral positions. In accordance with the preferred embodiment of the invention, the rod members cause the placing means 30 to position the switch 22 in the one position responsive to generally longitudinal travel of any one of the rod members 20*a*, 20*b* and 20*c* in either direction from the neutral position 32.

In accordance with the present invention, the switch placing means 30 includes a longitudinally extending actuating member 34 having first and second end portions 35 and 36 (see FIG. 2) and which is generally spaced from each of the rod members 20*a*, 20*b* and 20*c*, substantially an equal distance. Means 37 is provided for pivotally mounting the actuating member. In the embodiment illustrated in FIG. 1 the means 37 includes a pair of pivot pins 38 which serve for mounting the actuating member 34 to pivot about an axis 40 substantially parallel to the longitudinal extension of the actuating member 34 (FIGS. 3 and 4). Preferably, the pivot pins 38 are an integral part of end portions 35 and 36. Thus, the actuating member 34 would normally be mounted by the pivot pins 38, to a support structure 41, for example, the front panel of a battery compartment (not illustrated). An appropriately sized and shaped cover 42 generally surrounds the various structures and is mounted to the support structure 41. In the embodiment illustrated, the ends 35 and 36 of actuating members 34 are pivotally connected to respective brackets 44 and 46 by the pins 38.

Means 48 are provided for setting the switch 22 in said first position, responsive to rotating of the actuating member 34, in a direction 50 from a neutral position 51 thereof to a first (rotated) position 52 shown in phantom in FIGS. 3 and 4. The neutral position 51 corresponds to the rod members 20*a*, 20*b* and 20*c* all being in their neutral position 32. The means 48 for setting the switch 22, in the embodiment illustrated, comprises a switch actuating button 53 and a biasing spring 54 which normally biases the switch 22 open as shown in FIG. 1. The button 53 is preferably the head of a screw which provides fine adjustment of the opened and closed positions of the switch 22.

Means 56 serves for biasing the actuating member 34 in the neutral position 51. The particular biasing means 56 shown in the illustrated embodiment (see FIG. 2) is a spring 58 which acts between the support structure 41 and the actuating member 34.

Means 60 (see FIGS. 3 and 4) serves for pivoting the actuating member 34 in the direction 50, responsive to longitudinal movement of the rod structure 20, and more particularly responsive to longitudinal movement of any one of the rod members 20*a*, 20*b* and 20*c*, in either direction (upwardly or downwardly) from the neutral position 32. The illustrated pivoting means 60 includes a plurality of first members 62*a*, 62*b* and 62*c*, supported by the rod structure 20, in particular supported by the rod members 20*a*, 20*b* and 20*c* (20*b* in FIGS. 3 and 4), and positioned to contact a first face 64 of the actuating member 34 on a first side 66 of a plane 67 including the axis 40 and generally parallel to the rod members 20*a*, 20*b* and 20*c*. The pivoting means 60 also includes a plurality of second members 68*a*, 68*b* and 68*c* supported by the rod structure 20, (rod member 20*b* in FIGS. 3 and 4), and positioned to contact a second face 70 of the actuating member 34 on a second side 72 of the plane 67. Second members 68*a*, 68*b* and 68*c* each have an elongated slot 73 therein for permitting longitudinal adjustment of each of the second members relative to the rod structure 20.

In the embodiment of the invention illustrated in the drawings (see primarily FIG. 2), each of the rod members 20*a*, 20*b* and 20*c* is formed of a pair of bars 74 and 76, and the first members 62*a*, 62*b* and 62*c* serve to fasten together the two bars 74 and 76 at a point between their ends.

A top end of each of the bars 74 and 76 is pivotally attached at a pivot 78 to a respective lever 80*a*, 80*b* and 80*c* which serves to motivate the respective rod member 20*a*, 20*b* and 20*c* to move generally longitudinally up or down at the operator's choice.

A bottom end of each of the rod members 20*a*, 20*b* and 20*c* is pivotally attached at a respective pivot 82*a*, 82*b* 82*c*, to the respective control spool 18*a*, 18*b* and 18*c*. Thus, longitudinal movement of any one of the bar members 20*a*, 20*b* and 20*c* results in generally longitudinal movement of the respective spool 18*a*, 18*b* and 18*c*, which in turn adjusts the output of the respective control valve 16*a*, 16*b* and 16*c* to the respective hydraulic motor 28*a*, 28*b* and 28*c*.

The use of the two bars 74 and 76 is particularly advantageous in providing rigidity and strength with minimum weight and machining costs and eliminates the need for special connectors at the ends. Taking advantage of this structure, the particular actuating member 34 illustrated in the drawings includes a plurality of fingers 84*a*, 84*b* and 84*c* which extend to between the respective bars 74 and 76, and are in contact with the respective first members 62*a*, 62*b* and 62*c*. Thus, if one moves a respective one of the levers 80*a*, 80*b* or 80*c* to cause the respective rod member 20*a*, 20*b* or 20*c* to move upwardly, then the respective first member 62*a*, 62*b* or 62*c* pushes upwardly upon the respective finger 84*a*, 84*b* or 84*c* thus forcing the actuating member 34 to rotate in the first direction 50.

The second members 68*a*, 68*b* and 68*c*, as illustrated in the drawings, can be brackets which are attached to respective of the rod members 20*a*, 20*b* and 20*c*. Each of the second members 68*a*, 68*b* and 68*c* has a finger, 86*a*, 86*b* and 86*c*, which reaches over past the axis 40 to contact the second face 70 of the actuating member 34. When a respective lever 80*a*, 80*b* or 80*c* is rotated to cause its respective rod member 20*a*, 20*b* or 20*c* to move longitudinally downwardly, the respective finger 86*a*, 86*b* or 86*c* pushes downwardly upon the second face 70 of the actuating member 34 on the second side 72 of the axis 40. The actuating member 34 is thereby forced to rotate in the direction 50. It is further clear that, when the actuating member 34 is in the neutral position 51 illustrated in FIGS. 1 and 2, neither the first members 62*a*, 62*b* and 62*c* nor the second members 68*a*, 68*b* and 68*c* are causing rotation of said actuating member 34, and the spring 58 then causes the actuating member 34 to return to the neutral position 51.

What results from the above described arrangement is direct control of the switch 22 on linear movement of any of the rod members 20*a*, 20*b* and 20*c*. This provides precise control of the pump 14.

Adverting to FIG. 1, it will be noted that in certain instances it is desirable to have a control valve 88, which may be part of the stacked control valve arrangement 16 and may be controlled by movement of a control spool 90 thereof. This control valve 88 may control, for example, a function such as the lift function of a lift truck wherein the motor 12 is required to control the pump 14 to provide a much higher flow rate to a lift cylinder 91, than is required for any other function of the truck, and/or to provide a variable flow rate. The control spool 90 of the control valve 88 is controlled by linear movement of a rod member 92 which is pivotally connected at a pivot 94 to the control spool 90.

The rod member 92 is connected to the control spool 90 by a structure sufficient to cause longitudinal movement of the control spool 90 in response to generally longitudinally movement of the rod member 92. In such a situation, it is preferred to have means 96 (see FIGS. 1 and 2), for example, a potentiometer 98, to vary the amount of electric power supplied to the motor 12 responsive to longitudinal movement of the rod member 92. The potentiometer 98 may function in the manner discussed in previously mentioned U.S. Pat. No. 4,102,132. To control variation of resistance of the potentiometer 98, a control element 100 is provided adjacent the specific function rod member 92. Means 102 are provided for moving the control element 100 responsive to generally longitudinal movement of the specific function rod member 92 on rotation of a lever 101. In this manner, the means 96 serves for controllably varying the amount of electric power supplied to the motor 23 responsive to movement of the control member 100.

In the specific embodiment illustrated, the control element 100 is a rotary control shaft which extends from the potentiometer 98. The element moving means 102 has an arm 104 attached to extend generally radially from the rotary control shaft 100 to adjacent the rod member 92. The element moving means 102 also has means 106 for directly engaging the rod member 92 with the arm 104 as the rod member 92 moves in a first longitudinal direction 108 (upwardly in FIGS. 1 and 2) and means 110 for indirectly engaging the rod member 92 with the arm 104 via a spring 111 as the rod member 92 moves in a second longitudinal direction 112 (downwardly in FIGS. 1 and 2). It should be noted that the pivoting means 60 (FIGS. 3 and 4), for pivoting the actuating member 34, is not functionally connected to the rod member 92, and hence, does not pivot the actuating member 34 in the direction 50 responsive to longitudinal movement of the rod member 92. A switching function can be built into the potentiometer 98, or a separate switch may be tripped by the control spool 90, as in previously discussed U.S. Pat. No. 4,102,132, or the pumping system may be such that the pump 14 is continuously operating at a low speed, and the potentiometer 98 varies operation of the motor 12 to raise or lower the output of the pump 14.

Turning to the specific structure illustrated in FIGS. 1 and 2 for the direct engaging means 106 and the indirect engaging means 110 (the spring 111), it will be seen that a tab 114 extends laterally from the rod member 92 and is fastened thereto. A metal rod 116 fits through a hole 118 in the arm 104. The metal rod 116 then proceeds upwardly through a hole 120 in the tab 114. A loop 122 or other stop means is formed in the metal rod 116 just above the hole 120 in the tab 114. Thus, when one moves the rod member 92 upwardly the loop 112 is engaged by the tab 114 and begins pulling directly upwardly upon the arm 104 causing a rotation of the arm 104 in the direction 50.

It will be noted that the metal rod 116 continues upwardly from the loop 122 to a closed loop 123 at its top 124. The closed loop 123 is connected to the spring 111 by an integral hook 125. The spring 111 is connected by another integral hook 126 to a hole 127 in the tab 114.

A stop 128 formed in a bracket 130 serves to prevent the arm 104 from moving downwardly beyond a desired position corresponding to the rod member 92 being at its neutral position. It will be noted that the rod member 92 can still move downwardly beyond that position, since the spring 111 will simply be stretched by this motion. The stop 128 thus protects the potentiometer 98 from being damaged by overly rotating the control shaft 100 and provides a specific zeroing point for the resistance in the potentiometer 98.

INDUSTRIAL APPLICABILITY

The just described structure is particularly advantageous for use with lift trucks, and even more particularly advantageous for use with lift trucks of the electrically powered variety. The support structure 41 is normally the front of the battery compartment of such a lift truck, adjacent the operator's seat, which normally sits on top of the battery compartment. Because of the compact nature of the overall apparatus it can be conveniently placed in such a location.

The independent action of each of rod members 20*a*, 20*b* and 20*c* on member 34 is such that any up or down movement of any rod, 20*a*, 20*b* or 20*c*, rotates member 34 clockwise (FIGS. 3 and 4) about the axis 40 and activates the single switch 22 so that more pump power is produced. The direct action resulting from linear movement of the rod members 20*a*, 20*b* and 20*c* on the member 34 provides precise control of the pump 14 in response to such linear movement. Prior art multiple spool single switch control have not provided such precise control.

For such functions as tilting the mast assembly rearwardly and forwardly, side shifting of the carriage, or the like, operation of the respective levers 80*a*, 80*b* and 80*c* leads to direct control of hydraulic fluid when each rod member 20*a*, 20*b* and 20*c* is moved either longitudinally upwardly or longitudinally downwardly.

The potentiometer actuating member for the fourth function, which would normally be the lift function of a lift truck, allows the providing of a higher flow rate from the pump 14 in response to upward movement of the specific function rod member 92.

Other aspects, objects and advantages of this invention can be obtained from a study of the drawings, disclosure and the appended claims.

I claim:

1. In a hydraulic system (10) having an electric motor (12) driving a pump (14) which supplies pressurized fluid to a control valve arrangement (16) having a plurality of control valves (16*a*, 16*b*, 16*c*) each controlled by movement of a corresponding control spool (18*a*, 18*b*, 18*c*); a plurality of longitudinally movable rod members (20*a*, 20*b*, 20*c*) each having a rod member neutral position (32) and each being connected to one of said spools (18*a*, 18*b*, 18*c*), said spools (18*a*, 18*b*, 18*c*) each having a spool neutral position corresponding to the rod member neutral position (32) and being movable from said spool neutral position in response to generally longitudinally movement of a respective rod member (20*a*, 20*b*, 20*c*) from said rod member neutral position (32); a single switch (22) having first and second position, one of said positions being open and the other being closed; a circuit (24) controllably supplying power to said motor (12), said circuit (24) supplying a relatively greater amount of electric power to said motor (12) and causing the output of said pump (14) to increase in response to said switch (22) being moved to a selected one of said first and second positions, the improvement comprising:

an elongated actuating member (34) having a neutral position (51) and a rotated position (52);

means for mounting said elongated actuating member (34) transverse to said rod members (20*a*, 20*b*, 20*c*) and for pivoting about an axis (40) generally orthogonal to said rod members (20*a*, 20*b*, 20*c*), said axis (40) being generally in a plane (67) which is generally parallel to said rod members (20*a*, 20*b*, 20*c*);

means (56) for biasing said actuating member (34) in a direction towards said neutral position (51);

means (60) for engaging said rod member (20*a*, 20*b*, 20*c*) and said actuating member (34) for pivoting said actuating member (34) in one direction (50) from said neutral position (51) towards said rotated position (52) in response to longitudinal movement of one of said rod members (20*a*, 20*b*, 20*c*) in either direction from said neutral position (51); and means (48) for positioning said switch (22) in said selected one of said first and second positions in response to said actuating member (34) being at said rotated position (52).

2. The hydraulic system as set forth in claim 1, further including:

a control valve (88) having a control spool (90);

a rod member (92) movable in first (108) and second (112) longitudinal directions;

a structure (94) connecting said rod members (92) to said control spool (90);

a control element (100) adjacent said rod member (92);

means (102) for moving said control element (100) in response to generally longitudinal movement of said rod member (92), said means (102) being connected to said control element (100) and to said rod member (92); and means (96) for varying the amount of electric power supplied to said motor (12) in response to movement of said control element (100).

3. The hydraulic system as set forth in claim 2, wherein said switch positioning means (48) is free from connection with said rod member (92).

4. In a hydraulic system (10) having an electric motor (12) driving a pump (14) which supplies pressurized fluid to a control valve arrangement (16) having a plurality of control valves (16a, 16b, 16c) each controlled by movement of a corresponding control spool (18*a*, 18*b*, 18*c*); a plurality of longitudinally movable rod members ( 20*a*, 20*b*, 20*c*) each having a rod member neutral position (32) and each being connected to one of said spools (18*a*, 18*b*, 18*c*) each having a spool neutral position corresponding to the rod member neutral position (32) and being movable from said spool neutral position in response to generally longitudinal movement of a respective rod member (20*a*, 20*b*, 20*c*) from said rod member neutral position (32); a single switch (22) having first and second positions, one of said positions being open and the other being closed; a circuit (24) controllably supplying power to said motor (12) , said circuit (24) supplying a relatively greater amount of electric power to said motor (12) and causing the output of said pump (14) to increase in response to said switch (22) being moved to a selected one of said first and second positions, the improvement comprising:

an elongated actuating member (34) having a neutral position (51) and a rotated position (52), said actuating member (34) having a first face (64) and a second face (70);

means for mounting said elongated actuating member (34) transverse to said rod members (20*a*, 20*b*, 20*c*) and for pivoting about an axis (40) generally orthogonal to said rod members (20*a*, 20*b*, 20*c*), said axis (40) being generally in a plane (67) which is generally parallel to said rod members (20*a*, 20*b*, 20*c*);

means (56) for biasing said actuating member (34) in a direction towards said neutral position (51);

means (60) for engaging said rod member (20*a*, 20*b*, 20*c*) and said actuating member (34) for pivoting said actuating member (34) in one direction (50) from said neutral position (51) towards said rotated position (52) in response to longitudinal movement of one of said rod members (20*a*, 20*b*, 20*c*) in either direction from said neutral position (51) said engaging and pivoting means (60) including a plurality of first members (62*a*, 62*b*, 62*c*), each connected to a respective rod member (20*a*, 20*b*, 20*c*) and contactable with said first face (64) of said actuating member (34) at a location between said rod members (20*a*, 20*b*, 20*c*) and said axis (40); and a plurality of second members (68*a*, 68*b*, 68*c*), each connected to a respective rod member (20*a*, 20*b*, 20*c*) and each being positionable to contact said second face of said actuating member (34) at a location on an opposite side of said plane (67) from said rod members (20*a*, 20*b*, 20*c*); and means (48) for positioning said switch (22) in said selected one of said first and second positions in response to said actuating member (34) being at said rotated position (52).

5. The hydraulic system as set forth in claim 4, further including:

means (73) for adjusting the positions of each of the second members (68*a*, 68*b*, 68*c*) relative to the rod members (20*a*, 20*b*, 20*c*).

6. The hydraulic system as set forth in claim 4 wherein each of said second members (68*a*, 68*b*, 68*c*) includes a respective finger (86*a*, 86*b*, 86*c*), said fingers extending to a location on an opposite side of said plane (67) from said rod members (20*a*, 20*b*, 20*c*).

7. In a hydraulic system (10) having an electric motor (12) driving a pump (14) which supplies pressurized fluid to a control valve arrangement (16) having a plurality of control valves (16*a*, 16*b*, 16*c*) each controlled by movement of a corresponding control spool (18*a*, 18*b*, 18*c*); a plurality of movable rod members (20*a*, 20*b*, 20*c*) each having a rod member neutral position (32) and each being connected to one of said spools (18*a*, 18*b*, 18*c*) each having a spool neutral position corresponding to the rod member neutral position (32) and being movable from said spool neutral position in response to generally longitudinal movement of a respective rod member (20*a*, 20*b*, 20*c*) from said rod member neutral position (32); a single switch (22) having first and second positions, one of said positions being open and the other being closed; a circuit (24) controllably supplying power to said motor (12), said circuit (24) supplying a relatively greater amount of electric power to said motor (12) and causing the output of said pump (14) to increase in response to said switch (22) being moved to a selected one of said first and second positions, the improvement comprising:

an elongated actuating member (34) having a neutral position (51) and a rotated position (52);

means for mounting said elongated actuating member (54) transverse to said rod members (20*a*, 20*b*, 20*c*) and for pivoting about an axis (40) generally orthogonal to said rod members (20*a*, 20*b*, 20*c*), said axis (40) being generally in a plane (67) which is generally parallel to said rod members (20*a*, 20*b*, 20*c*);

means (56) for biasing said actuating member (34) in a direction towards said neutral position (51);

means (60) for engaging said rod member (20*a*, 20*b*, 20*c*) and said actuating member (34) for pivoting said actuating member (34) in one direction (50) from said neutral position (51) towards said rotated position (52) in response to longitudinal movement of one of said rod members (20*a*, 20*b*, 20*c*) in either direction from said neutral position (51);

means (48) for positioning said switch (22) in said selected one of said first and second positions in response to said actuating member (34) being at said rotated position (52);

a control valve (88) having a control spool (90);

a rod member (92) movable in first (108) and second (112) longitudinal directions;

a structure (94) connecting said rod members (92) to said control spool (90);

a control element (100) adjacent said rod member (92);

means (102) for moving said control element (100) in response to generally longitudinal movement of said rod member (92), said means (102) being connected to said control element (100) and to said rod member (92);

means (96) for varying the amount of electric power supplied to said motor (12) in response to movement of said control element (100), said power varying means (96) including a potentiometer (98), said control element (100) including a rotary control shaft (100) extending from said potentiometer (98), and said element moving means (102) including:

an arm (104) attached to said shaft (100) to extend generally radially therefrom to a location adjacent said rod member (92);

means (128) for stopping rotation of said arm (104) in one direction beyond a selected position;

means (106) for directly engaging said rod member (92) to said arm (104) in response to movement of said rod member (92) in said first longitudinal direction (108) and rotating said arm (104) and said shaft (100) opposite said one direction; and means (110) for indirectly engaging said rod member (92) to said arm (104) in response to movement of said rod member (92) moving in said second longitudinal direction (112) and moving said arm (104) in said one direction and permitting said rod member (92) to move in said second longitudinal direction (112) after said arm (104) has reached said selected position.

8. In a hydraulic system (10) having an electric motor (12) driving a pump (14) which supplies pressurized fluid to a control valve (88) having a control spool (90) controlled by movement of a generally longitudinally movable rod member (92), said rod member (92) being movable in a first (108) and a second (112) direction, a control element (100) adjacent said rod member (92), means (102) for moving said control element (100) in response to generally longitudinal movement of said rod member (92), means (96) for varying the amount of electric power supplied to said motor (12) in response to movement of said control element (100) and means (128) for preventing said control element (100) from being moved in one direction beyond a preselected position, the improvement comprising:

means (110) for permitting said rod member (92) to continue to move in said second longitudinal direction (112) after said control element (100) is at said preselected position.

9. The hydraulic system as set forth in claim 8, wherein said means (110) includes a spring (111) connected between said rod member (92) and said control element (100).

* * * * *